United States Patent [19]

Wright

[11] 4,390,071

[45] Jun. 28, 1983

[54] REPLACEABLE CUTTING BLADE ASSEMBLY FOR DOZERS

[75] Inventor: Richard E. Wright, Bucyrus, Ohio

[73] Assignee: Paper, Calmenson & Co., Saint Paul, Minn.

[21] Appl. No.: 96,892

[22] Filed: Nov. 23, 1979

[51] Int. Cl.[3] ..... E02F 9/28

[52] U.S. Cl. ..... 172/701.3; 37/141 R

[58] Field of Search ..... 172/777, 719, 702, 703, 172/704, 747, 735, 736, 737, 701.1, 701.2, 701.3; 37/141 R, 141 T, 142 R

[56] References Cited

U.S. PATENT DOCUMENTS

| | | | |
|---|---|---|---|
| 2,094,424 | 9/1937 | Cole | 172/704 |
| 2,257,992 | 10/1941 | Vaughn | 37/118 R |
| 2,329,831 | 9/1943 | Ferguson | 37/141 R |
| 2,485,407 | 10/1949 | Peterson | 172/701.3 |
| 2,708,865 | 5/1955 | Frevik | 172/753 |
| 2,778,129 | 1/1957 | Fryer | 37/141 R |
| 2,981,015 | 4/1961 | Duke | 37/141 T |
| 3,011,274 | 12/1961 | Richter | 37/141 R |
| 3,190,018 | 6/1965 | Nelson | 172/719 X |
| 3,469,331 | 9/1969 | Wood | 172/719 |
| 3,648,391 | 3/1972 | Kabay | 37/141 T |
| 3,851,711 | 12/1974 | Stepe | 37/141 R |
| 3,857,447 | 12/1974 | Adams | 172/777 |

OTHER PUBLICATIONS

Caterpillar Product Line, p. 18, Published for Caterpillar Corp., Peoria Ill.

*Primary Examiner*—Richard J. Johnson

*Attorney, Agent, or Firm*—Hughes, Barnard & Cassidy

[57] ABSTRACT

A replaceable cutting blade assembly for a dozer is designed to present at least three, and optionally four, potential working edges.

15 Claims, 9 Drawing Figures

REPLACEABLE CUTTING BLADE ASSEMBLY FOR DOZERS

BACKGROUND OF THE INVENTION

1. Field of the Invention

The present invention relates generally to replaceable cutting blade assemblies for earth-working apparatus. More specifically, the present invention relates to a replaceable cutting blade assembly adapted for use on a dozer; which is designed to provide at least three, and optionally four, potential working edges. The blade assembly is adapted for use on all varieties of dozers, whether straight, angle, U or semi-U; but finds its most advantageous application in conjunction with U-dozers and semi-U-dozers.

2. Description of the Art

Replaceable cutting blade assemblies have been employed on all types of earth-working apparatus for quite some time. These replaceable blades provide a sacrificial working edge for the earth-working blade or moldboard, which may be abraided away during service without damage to the large blade structure itself.

In the context of the present invention, dozer blades, and particularly U-dozer blades, are designed to move tremendous quantities of material which might be coal, rock, dirt, mineral ores, and the like. These are very abrasive materials, and tend to wear away a blade quite rapidly. Because of the substantial costs involved, it is impractical to replace moldboards. Rather, it has become commonplace to attach a sacrificial edge to the lower working surface of the dozer moldboard. These sacrificial, replaceable blades are used until worn beyond serviceability, and are then discarded in favor of a new blade assembly.

The use of replaceable sacrificial blades overcomes this problem of wearing out a moldboard along the working edge. Further efficiencies have been obtained by structuring the sacrificial blade in a way that allows it to be repositioned on the moldboard once a first working edge has been used, to provide a second working edge. This is desirable because it maximizes the life of one of these blades.

SUMMARY OF THE INVENTION

The present invention provides a new and improved replaceable cutting blade assembly for use as a sacrificial edge along a dozer moldboard. The assembly is adapted for use with all varieties of dozer blades, whether straight, angle, U or semi-U. The assembly is particularly advantageous when used on a U-dozer blade. For the sake of convenience, as used herein the term "U-dozer" will be used to connote either a true U-dozer and a semi-U-dozer blade configuration.

The blade of the present invention is designed to present at least three, and optionally four, potential working edges, as opposed to only two as may be had by utilizing prior art blade assemblies. A highly preferred embodiment for achieving this advantage for a U-dozer is comprised of a center section blade having an offset miter at either transverse edge, first and second tapered working edges and first and second longitudinal rows of bolt holes for securing the blade assembly to the moldboard; in combination with suitably modified intermediate section blades, and end bits.

The center section blade and intermediate section blades are attached to the moldboard through first sets of bolt holes and a first edge is presented for use as the sacrificial cutting edge. After the first edge has been worn to a sufficient degree, the blades are lowered by securing them to the moldboard through second rows of bolts holes, which are vertically displaced from the first rows, to present a second edge. This second sacrificial edge is used until it is worn to an appropriate extent. A third working edge is presented by turning the blades end-for-end and using the second tapered edges. An optional fourth working edge may be had by rotating the blades prior to the time when the first sets of bolt holes have been worn through during the time the blade is attached through the second row of bolts holes.

For straight- or angle-dozer blades, the assembly is still comprised of a center section blade, intermediate section blades and end bits. The cross-sections for each of these components is the same as for the U-dozer blade; but the offset miters on the center section blade are omitted as they are not required.

Other advantages of the present invention will become apparent to the skilled artisan upon examination of the detailed description of preferred embodiments, taken in conjunction with the figures of drawing, wherein:

DETAILED DESCRIPTION OF THE INVENTION

The present invention relates to replaceable cutting blade assemblies used to provide a sacrificial working edge for dozer blades. The blade assemblies disclosed herein are adapted for use with all varieties of dozer blades, whether straight, angle or U. However, the new blade assemblies are particularly advantageous when used on a U-dozer. For the sake of convenience, the term "U-dozer" is used to connote either a true U-blade or a semi-U-blade. To adequately describe this blade assembly, the following description is given in terms of certain preferred embodiments thereof, with specific reference to U-dozers; which preferred embodiments are meant to be illustrative only and should not be deemed limitative.

Figure 1:
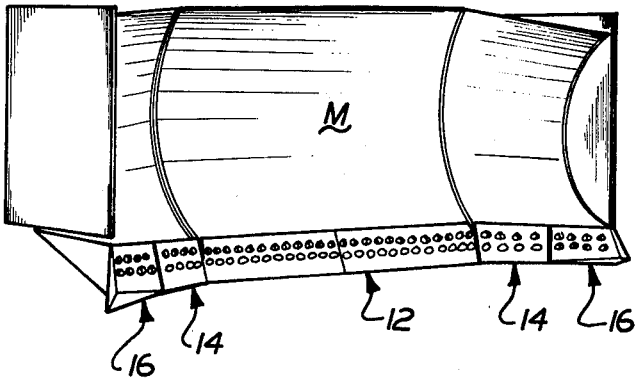
FIG. 1 is a perspective view of a U-dozer moldboard having a replaceable cutting blade assembly in accordance with the present invention.
Figure 2:
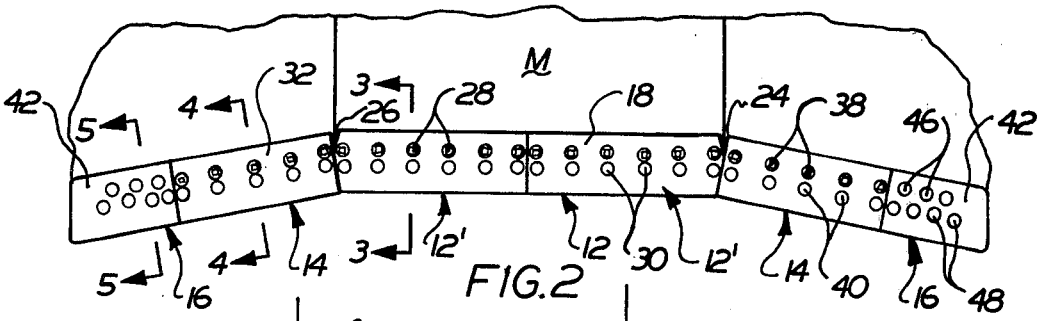
FIG. 2 is a side elevational view of the replaceable cutting blade assembly of the present invention, shown attached to a U-board.

FIG. 1 shows a U-dozer moldboard M to which is secured a cutting blade assembly in accordance with the present invention, designated generally as 10. The assembly 10, as best viewed in FIG. 2, is comprised of a center section 12, intermediate sections 14, and end bits 16. The assembly shown in FIGS. 1 and 2 is illustrated as having a two-piece center section 12 comprised of complementary segments 12'. Obviously, this does not differ from a single-piece center section in operation;

and the assembly could equally well employ a one piece center section.

The center section blade 12 presents a working face 18 for contacting the material (e.g., coal) to be moved by the dozer. A first tapered working edge 20 is formed along the lower longitudinal edge of the center section 12, the edge having a taper angle $\alpha$. This taper angle $\alpha$ may vary, but it has been determined that an angle in the range of from 30° to about 40° is preferable. Most preferably, the angle $\alpha$ will be about 35°.

A second tapered working edge 22 is formed at the upper longitudinal edge of the center section 12, the taper angle for this edge being denoted as $\beta$. The taper angle $\beta$ may vary within a preferred range of from about 20° to about 35°. Most preferably, the taper angle $\beta$ will be about 25°.

The angle $\alpha$ is chosen to provide optimum wear characteristics for the blade, as is the angle $\beta$. Along these lines, the angle $\beta$ is typically shallower than that for angle $\alpha$, in order that any weld bead along the lower edge of the moldboard M might be accommodated. Such a weld bead might be present on the moldboard where, for example, the face has been rebuilt due to wear following extended periods of use. Consequently, although the ranges for the taper angles overlap, under most circumstances the angles $\alpha$ and $\beta$ will be unequal. However, those skilled in the art can, consistent with the foregoing parameters, choose appropriate taper angles for the blade to meet their specific working requirements.

A pair of offset miters 24 and 26 are formed along the right and left transverse edges of the center section blade 12, respectively. It is customary to provide blade assemblies for a U-board with similar miters in order that the intermediate blade sections 14 can be properly positioned on the moldboard. But, shown in the figures of drawing, the miters 24 and 26 are offset toward the upper or second edge 22. This differs from known blades in that the miter is normally centered across the face 18 of the blade section 12 such that the point of the miter is located substantially coincident with the centerline of the face 18. The present assembly also differs from conventional designs in that the miters 24 and 26 are skewed; i.e., the horizontal projection of the tip of each miter along the first edge 20 is somewhat greater than the same projection along the upper edge 22. This relationship is discussed more fully hereinbelow with respect to exemplary dimensions for a representative blade.

Two sets of bolts holes 28 and 30 are formed across the working face 18 of the center section 12. The upper row of bolt holes 28 lies along the line extending between the tips of the two miters 24 and 26. Accordingly, because these miters are offset, the row of bolt holes 28 is likewise offset across face 18 of blade 12. This, in turn, presents two blade segments of differing dimensions across the working face 18; a first, somewhat larger segment extending between the row 30 and corresponding edge 20 and a second, somewhat smaller segment extending between the row 28 and corresponding edge 22. The lower row of bolt holes 30 is located at a distance beneath the upper row corresponding to the desired degree of adjustment depth for the blade assembly, as explained more fully hereinbelow. As is conventional, the bolt holes comprising the rows 28 and 30 have a countersunk portion within which to receive fixture bolts.

The intermediate sections 14 of the blade assembly 10 are formed to have a corresponding cross-sectional geometry with respect to that of a center section 12. In this regard, each of the blade sections 14 is comprised of a working face 32 which terminates along its lower edge in a tapered working edge 34 and its upper edge in a tapered working edge 36. The taper angles $\alpha$ and $\beta$ for these intermediate sections 14 are the same as those angles $\alpha$ and $\beta$ for center section 12. Likewise, two sets of bolt holes 38 and 40 are formed across the working face 32 of the intermediate blade section 14. The rows 38 and 40 are positioned to correspond with the location of the rows 28 and 30; whereby the working edges of the intermediate sections 14 will be properly located on the moldboard M.

End bits 16 complete the assembly 10. The end bits may be of any standard cross-section; e.g., formed or flat. Preferably, however, the end bits 16 present a working face 42 which terminates at its lower edge in a tapered working edge 44 having a taper angle $\alpha$ corresponding in magnitude to the angles $\alpha$ of both the intermediate sections 14 and the center section 12. Two rows of bolt holes 46 and 48 are formed across the working face 42 of each end bit 16. As opposed to the bolt holes in rows 28, 30, 38, and 40, the bolt holes in rows 46 and 48 are countersunk from both sides, as best viewed in FIG. 5. Therefore, an end bit may be used at either the right-hand or left-hand side of the assembly 10. However, this is an entirely optional design consideration with respect to the overall assembly.

Figure 3:
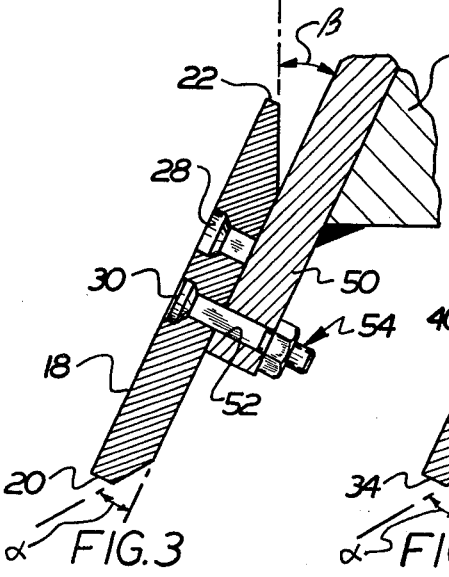
FIG. 3 is a sectional view taken substantially along the line 3—3 of FIG. 2.
Figure 4:
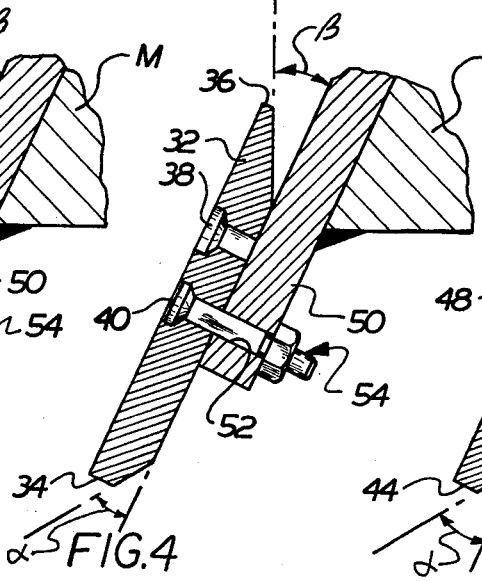
FIG. 4 is a sectional view taken substantially along the line 4—4 of FIG. 2.
Figure 5:
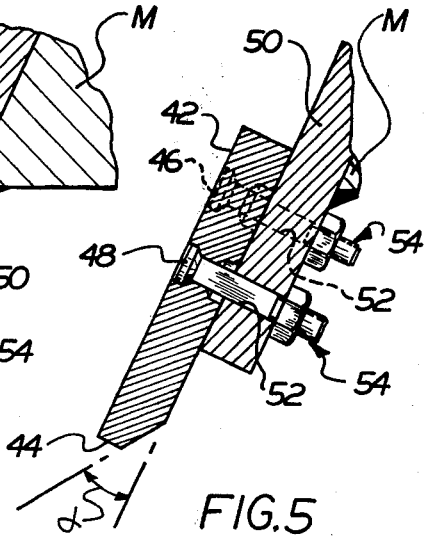
FIG. 5 is a sectional view taken substantially along the line 5—5 of FIG. 2; and, FIGS. 6–9 show, incrementally, the manner in which four working surfaces are provided by the replaceable cutting blade of the present invention.

As best viewed in FIGS. 3–5, the components of the assembly 10 are attached to a lip 50 which is welded along the bottom edge of the moldboard M. The lip 50 is provided with a single row of bolt holes 52 which receive threaded bolts or other suitable fasteners 54 for attachment of the component sections 12 and 14 of the blade assembly 10 to the moldboard M. The lip 50 is provided with two sets of bolts holes near its ends, where the end bits are to be located; and the end bits 16 are secured to the moldboard by bolts through both rows of holes 46 and 48.

The material from which the blade assembly 10 is fabricated may be one of a number of conventional steels. However, it has been determined that optimum serviceability of the blade of the present invention is obtained by employing a low alloy steel marketed by the assignee of the present invention under the name "Tensiloy". This alloy has the following nominal composition: 0.27–0.33 C, 0.80–1.10 Mn, 0.035 (max)P, 0.5 (max)S, 0.15–0.30 Si, 0.003–0.005 B, balance Fe. Most preferred is a steel having the foregoing composition where the manganese level is adjusted to be from 1.0 to 1.5 percent.

To provide optimum operating characteristics for the blade assembly of the present invention, it has been determined that the blade components should be through-hardened so that the core attains a nominal hardness of $R_c$ 38-52. This hardness is achieveable by using the aforementioned composition with the most preferred range of manganese, which is subjected to conventional heat treatment followed by a quench and temper. Those skilled in the art will have no difficulty in tailoring a specific heat treating sequence to achieve these results. By coupling the specified range of hardness with a yield strength in the range of from about 125,000–200,000 psi, appropriate toughness is achieved for the blade components. An optimum yield strength for this hardness range is about 150,000 psi. Depending upon the type of service to which the blade will be put, many other steel compositions might be employed, and other physical characteristics be imparted to the blade. Selection of suitable compositions and heat treatments may be made by those skilled in the art as required.

The characteristics of the blade components are somewhat related to the overall physical dimensions thereof. By way of nonlimiting example, it has been found that a desirable ratio for the height of the working faces, for both the center section blade 12 and intermediate section blade 14, to the thickness thereof may vary in the range of from about 5:1 to about 9:1. Optimally, this ratio will be about 8:1.

Obviously, the length dimension of the blade is not of material importance in attaining the desired metallurgical characteristics for the blade components. However, there is a highly preferred relationship, similar to the aforenoted ratio, between the height of the working face 18 and the projection of the offset miters. For example, for a blade 12 having a working face 18 which is about 16 inches high, the tip of each of miters 24 and 26 will be approximately 5½ inches below the edge 22, the horizontal projection of the miter tip on the edge 20 will be about 2 inches, and the horizontal projection of the miter tip on the edge 22 will be about 1-1/16 inches. While these dimensions are not critical in any way to the successful operation of the present invention, they are optimum in the sense that they provide a particularly good fit between the components comprising the blade assembly.

Once the blade has been fabricated as outlined above, it is secured to moldboard M as shown in FIG. 2. The advantage of providing at least three, and optionally four, working edges is shown in FIGS. 6–9, which represent sectional views through the center section 12 at various incremental positions of the blade.

Figure 6:
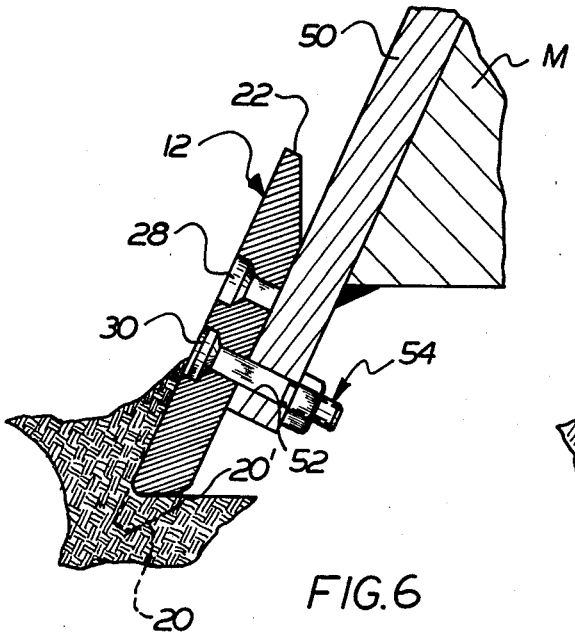

The blade is first attached as shown in FIG. 6, with the bolts passing through the lower row of bolt holes 30 in the blade 12. During service, the lower or first working edge 20 will be worn away from its original configuration (shown in phantom lines) to a point 20' requiring adjustment of the blade for optimum use.

Figure 7:
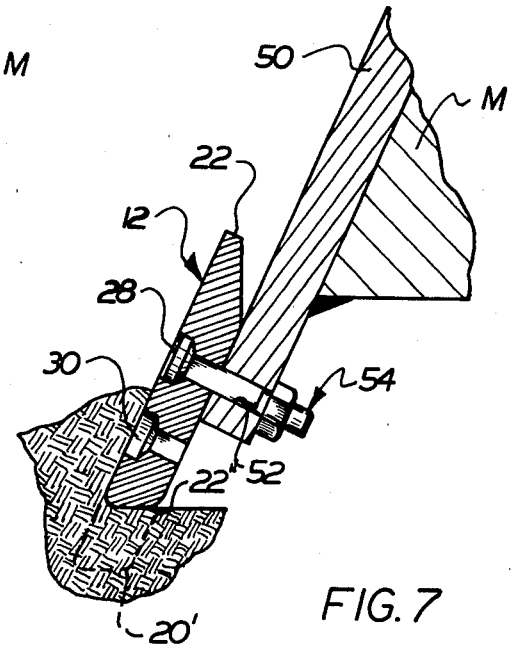

At this time, the blade is lowered to the position shown in FIG. 7, wherein the blade 12 is attached to the moldboard through the upper row of bolt holes 28. This lowers the working edge 20' to a position shown in phantom lines in FIG. 7. Further use of the blade results in a wearing of the same so that this second working edge is reduced to the surface identified as 20'' in FIG. 7.

Figure 8:
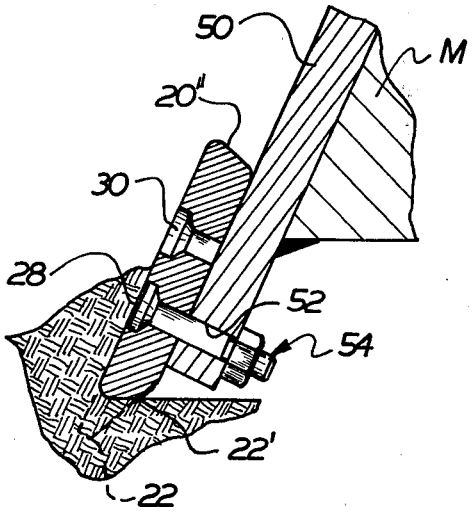

The blade is then removed from the moldboard and turned end-for-end to present the upper wearing edge 22 for service. As shown in FIG. 8, the blade 12 is now secured to the moldboard through the row of bolt holes 28. The blade is used until the original edge 22, shown in phantom lines in FIG. 8, is worn black to the point identified as 22'.

Figure 9:
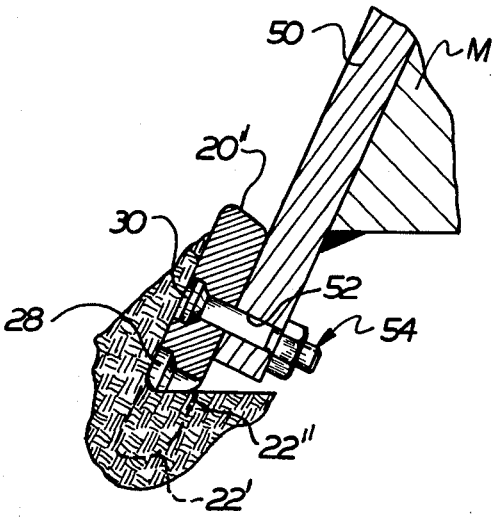

The fourth wearing surface is achieved by lowering the blade 12 from the position shown in FIG. 8 to that shown in FIG. 9; whereby the blade is secured to the moldboard through the row of bolt holes 30. This positions the edge 22' as shown in phantom lines in FIG. 9; whereupon the blade continues in use until it is worn to the point identified as 22'' in FIG. 9. At that time, the blade may be discarded and replaced by a new assembly.

As the center section 12 is repositioned as shown in FIGS. 6–9, corresponding adjustments are made to both intermediate sections 14. In this regard, the pattern of adjustment for the intermediate sections follows identically with that shown in FIGS. 6–9. Because of the harsher conditions at the ends of the dozer blade, the end bits 16 will normally be replaced each time an adjustment is made to the center and intermediate section blades.

As noted above, the working surface 22, corresponding to the third working edge, is presented for use prior to the time when the edge 20'' substantially encroaches on the material surrounding the row of bolt holes identified as 30. In this way, four working edges may be realized from the same blade. Under some circumstances this is not an essential requirement, and the ability to have three working surfaces is sufficient. In such a case, the edge 20' may be allowed to actually penetrate into the row of bolt holes 30 before reversing the blade. Accordingly, under those circumstances, the progression would follow from FIG. 6 to FIG. 7 to FIG. 9.

The foregoing description has been made with reference to a cutting blade assembly 10 specifically adapted for use on a U-dozer blade moldboard. However, the present invention is broadly applicable to all varieties of dozer blades, including straight and angle dozer blades. The difference between, for example, a straight dozer blade assembly in accordance with the present invention and the assembly 10 disclosed above is simply that the offset miters 24 and 26 are omitted for the straight blade configuration. The same is true for an assembly adapted for use on a angle dozer blade. Otherwise, the blade assemblies are identical in respect of the cross-sectional configuration. In the same manner as described with reference to FIGS. 6–9, at least three, and potentially four, sacrificial working edges may be presented for straight and/or angle dozer blades by providing the two tapered working edges and two longitudinal rows of bolt holes across the working faces of the component blade sections. Further in this regard, the entire replaceable blade for a straight or angle dozer might comprise a single center section blade bounded at either end by end bits. However, for practical reasons, especially for large dozers, the blade for straight- or angle-dozer application will be segmented into two or more components.

A great number of substantial advantages are realized by utilizing the blade assembly of the present invention. It is apparent that the ability to present at least three, and optionally four, sacrificial working edges is a significant advantage over prior art designs which are present, at best, two sacrificial edges. This reduces both the inventory requirements of those who utilize these devices, and the effective amount of "down time" for the dozer itself. Also, by employing the preferred materials for fabricating the blade of the present invention, substantially greater serviceability of the blade is achieved. All things considered, it is presently estimated that the blade of the present invention will yield at least three times the effective life of a conventional heat-treated replacement blade.

While the invention has now been described with reference to certain preferred embodiments, the skilled artisan will appreciate that various substitutions, modifications, changes, and omissions may be made without departing from the spirit thereof. Accordingly, it is intended that the scope of the present invention be limited solely by that of the following claims.

What is claimed is:

1. A replaceable cutting blade assembly for a U-dozer blade adapted for adjustable securement to a moldboard up to four times in four different configurations during the service life of said blade assembly to provide four positions of adjustment therefor, said assembly comprising a center section blade having a face with a longitudinal centerline thereacross and being bounded by first and second longitudinal working edges and opposing, mitered transverse edges having outwardly projecting miter tips, said center section blade further including at least one longitudinal row of bolt holes formed therein for securement thereof to said moldboard; wherein each of said miter tips is offset along said transverse edge intermediate said longitudinal centerline and one of said longitudinal working edges.

2. The replaceable cutting blade assembly of claim 1, wherein the horizontal projection of said miter tips along a first longitudinal edge of said center section blade is greater than the horizontal projection along the second longitudinal edge thereof.

3. The replaceable cutting blade assembly of claims 1 or 2, wherein the first longitudinal edge is a tapered working edge having a taper angle in the range of from about 30° to about 40°, and the second longitudinal edge is a tapered working edge having a taper angle in the range of from about 20° to about 35°.

4. The replaceable cutting blade assembly of claim 3, wherein the taper angles for said first and second edges are unequal.

5. The replaceable cutting blade assembly of claim 4, wherein the taper angle of said first edge is about 35°, and the taper angle of said second edge is about 25°.

6. The replaceable cutting blade assembly of claim 3, further comprising a pair of intermediate section blades having tapered working edges with taper angles matching the taper angles on said center section blade.

7. The replaceable cutting blade assembly of claims 1 or 2, further comprising upper and lower longitudinal rows of bolt holes across the working face of said center section blade, wherein said upper row of holes lies on a line coincident with the tips of said offset miters.

8. The replaceable cutting blade assembly of claim 7, further comprising a pair of intermediate section blades having upper and lower longitudinal rows of bolt holes matching the upper and lower longitudinal rows of bolt holes in said center section blade.

9. The replaceable cutting blade assembly of claims 1 or 2, wherein the ratio of the height of the working face of said center section blade to the thickness thereof is from about 5:1 to about 9:1.

10. The replaceable cutting blade assembly of claim 9, wherein said height to thickness ratio is about 8:1.

11. The replaceable cutting blade assembly of claims 1 or 2, further comprising a pair of intermediate section blades disposed proximate either transverse edge of said center section blade.

12. The replaceable cutting blade assembly of claim 11, further comprising a pair of end bits disposed proximate the ends of said intermediate section blades.

13. The replaceable cutting blade assembly of claim 12, wherein all of the blade sections are through-hardened, low alloy steel having a core hardness in the range of from about $R_c38$–$R_c52$.

14. The replaceable cutting blade assembly of claim 6, bounded on either side by intermediate section blades having the identical cross-sectional configuration as said center section blade and butted at either end thereof along substantially straight transverse edges with the lower portion of said mitered transverse edge and a pair of end bits at either end of the assembly.

15. A replaceable cutting blade assembly for a U-dozer blade adapted for adjustable securement to a moldboard up to four times in four different configurations during the service life of said blade assembly to provide four positions of adjustment therefor, said assembly comprising a center section blade having a face bounded by first and second longitudinal, tapered working edges and opposing, mitered transverse edges having outwardly projecting miter tips, said center section having two longitudinal rows of bolt holes formed therein for selective securement thereof to said moldboard; wherein, the taper angle of said first edge is in the range of from about 30° to about 40° and the taper angle of said second edge is in the range of from about 20° to about 35°, each of said miter tips is offset upwardly with respect to the longitudinal centerline of said blade and has a horizontal projection along said first longitudinal edge greater than the horizontal projection along said second longitudinal edge, and said first row of bolt holes lies along a line coincident with the tips of said miters.

* * * * *